US007018009B2

(12) United States Patent
Isono et al.

(10) Patent No.: US 7,018,009 B2
(45) **Date of Patent: *Mar. 28, 2006**

(54) RECORDING METHOD AND RECORDING APPARATUS

(75) Inventors: Masahiro Isono, Nagano (JP); Etsuo Tsuji, Nagano (JP); Mamoru Ukita, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/998,896

(22) Filed: Nov. 30, 2004

(65) Prior Publication Data

US 2005/0093906 A1 May 5, 2005

Related U.S. Application Data

(63) Continuation of application No. 10/263,353, filed on Oct. 3, 2002, now Pat. No. 6,840,691.

(30) Foreign Application Priority Data

Oct. 3, 2001 (JP) ..... P2001-307578

(51) Int. Cl.

| | |
|---|---|
| ***B41J 29/38*** | (2006.01) |
| ***B41J 2/21*** | (2006.01) |
| ***B41J 2/01*** | (2006.01) |
| ***B41J 11/42*** | (2006.01) |

(52) U.S. Cl. ..... 347/16; 347/43; 347/104; 400/579

(58) Field of Classification Search ..... 400/579, 400/625, 624; 271/265.01, 625.01; 347/16, 347/41, 101, 104, 35, 36

See application file for complete search history.

(56) References Cited

U.S. PATENT DOCUMENTS 5,890,708 A 4/1999 Song
6,840,691 B1 * 1/2005 Isono et al. ..... 400/579
2002/0070991 A1 6/2002 Otsuki

FOREIGN PATENT DOCUMENTS

| | | |
|---|---|---|
| JP | 2000-351205 A | 12/2000 |
| JP | 2001-113690 A | 4/2001 |
| JP | 2001-219548 A | 8/2001 |
| JP | 2001-260391 A | 9/2001 |

OTHER PUBLICATIONS

Japanese Office Action dated Apr. 23, 2004.

* cited by examiner

*Primary Examiner*—Shih-Wen Hsieh
(74) *Attorney, Agent, or Firm*—Sughrue Mion, PLLC

(57) ABSTRACT

A first region is defined on the head face so as to include a first group of nozzles among all nozzles formed with a recording head. A first amount is defined as a difference between a first reference position at which a leading edge of a recording medium situated at a recording start position is placed and a first shifted position at which the leading edge of the recording medium, which has been most shifted in a subscanning directions and most inclined within a feeding tolerance of a feeder, is placed. A first virtual leading edge is defined at a position where is shifted from the first reference position to a downstream side of the subscanning directions by the first amount. A second virtual leading edge at a position where is shifted from the first reference position to an upstream side of the subscanning directions by the first amount. A first type of recording is performed with the first group of nozzles, when an end of the first region in the upstream side of the first directions is situated at the first virtual leading edge. A second type of recording is performed with all the nozzles, when the end of the first region in the upstream side of the first directions is situated at the second virtual leading edge.

8 Claims, 13 Drawing Sheets

RECORDING METHOD AND RECORDING APPARATUS

This is a continuation of application Ser. No. 10/263,353, filed Oct. 3, 2002, now U.S. Pat. No. 6,840,691.

BACKGROUND OF THE INVENTION

The invention relates to a recording method which records data on recording paper by alternately repeating an operation for reciprocating within a recording area in a main scanning direction while a recording head provided with a group of nozzles ejects ink onto recording paper, and an operation for transporting the recording paper in a subscanning direction at a predetermined transport rate, thereby recording data on recording paper without margins while discarding ink outside four sides of the recording paper. The invention also relates to a recording apparatus which performs such a recording method.

A method of recording data on recording paper while a margin of given width is provided at four respective sides of the recording paper is commonly employed as a method of recording image data or the like on recording paper through use of a recording apparatus such as an ink jet recording apparatus. For instance, in an ink jet recording apparatus, when ink is ejected onto a recording surface of recording paper from a group of nozzles provided on a head surface of the recording head, data are recorded on recording paper without ensuring margins at four sides of the recording paper while ink is over-sprayed outside the recording paper (this operation is called hereinafter a "marginless recording operation") when data are recorded onto the leading edge or trailing edge of recording paper or within the vicinities of side edges of recording paper.

Since data are recorded within the vicinities of edges of the recording paper while ink is over-sprayed outside recording paper, the recording apparatus is equipped with ink receiving sections for receiving over-spray ink, which would otherwise stain the recording apparatus. The ink receiving sections are usually materialized by placing ink absorbing material into long trenches formed along a path along which recording paper is to be fed (hereinafter simply called an "paper feeding path"). Over-spray ink is absorbed by the ink absorbing material, thereby preventing adhesion of the over-spray ink to the paper feeding path. A platen for regulating an interval between the head surface of a recording head and a recording surface; that Is, a so-called paper gap, is provided along the feeding path located in the vicinity of an area in which a recording head performs recording operation. The recording paper is fed in a subscanning direction while remaining in slidable contact with the platen. The ink receiving sections are provided individually on the platen so as to correspond to four sides of the recording paper.

The ink receiving sections for receiving over-spray ink, which arises when data are recorded on the leading and trailing edges of the recording paper while ink is sprayed outside the recording paper, are embodied as long trenches which have narrow widths and extend in the main scanning direction, so as to prevent deterioration of regulation accuracy of the paper gap of the platen. Recording operation is carried out by causing a portion of nozzles corresponding to the width of the long trench to eject ink. Consequently, data can be recorded on the leading and trailing edges of the recording paper without involvement of an increase in the regulation accuracy of the paper gap of the platen and without staining the platen, which would otherwise be caused by ejection of ink.

In a period during which data are recorded on the leading and trailing edges of recording paper and the vicinities thereof, ink is ejected from only a portion of all nozzles. During that period of time, throughput of the recording apparatus is deteriorated as compared with that achieved when recording operation is carried out by use of all the nozzles. Therefore, the smaller the print areas that are provided around the leading and trailing edges of recording paper at which ink is ejected from only a portion of nozzles, the smaller the recording area where throughput is deteriorated. Therefore, throughput of marginless recording operation can be improved.

However, in relation to the conventional marginless recording operation, a recording area in which ink is ejected from only a portion of nozzles is set fairly broad within a range in which staining the platen with ink is not permitted. The recording area is not necessarily set to a minimal area; that is, an optimal area. For this reason, a problem of deterioration of throughput which would arise at the time of marginless recording operation remains unsolved while room remains for diminishing deterioration of throughput.

SUMMARY OF THE INVENTION

It is therefore an object of the invention to provide a recording method which diminishes deterioration of throughput during marginless recording operation, by minimizing a recording area in which ink is ejected from a portion of nozzles, and a recording apparatus which performs such a recording method.

In order to achieve the above object, according to the present invention, there is provided a method of recording information on a recording medium without leaving any margins along at least one of four sides thereof by a recording apparatus provided with a feeder for feeding the recording medium into a recording region, a transporter for transporting the recording medium in first directions and a recording head having a head face formed with nozzles for ejecting ink drops onto the recording medium while being reciprocated in second directions perpendicular to the first directions, the method comprising the steps of:

defining a first region on the head face so as to include a first group of nozzles among all the nozzles;

defining a first amount, as a difference between a first reference position at which a leading edge of the recording medium situated at a recording start position is placed and a first shifted position at which the leading edge of the recording medium, which has been most shifted In the first directions and most inclined within a feeding tolerance of the feeder, is placed;

defining a first virtual leading edge at a position where is shifted from the first reference position to a downstream side of the first directions by the first amount;

defining a second virtual leading edge at a position where is shifted from the first reference position to an upstream side of the first directions by the first amount;

performing a first type of recording with the first group of nozzles, when an end of the first region in the upstream side of the first directions is situated at the first virtual leading edge; and performing a second type of recording with all the nozzles, when the end of the first region in the upstream side of the first directions is situated at the second virtual leading edge.

Here, the first reference position means that the position of a leading edge achieved on the assumption that the recording medium fed by the feeder is not at all deviated or inclined. Therefore, the first amount is a value which indicates the potential maximum deviation of the leading edge of the recording medium as determined by the feeding accuracy of the feeder and which changes according to the size of recording medium.

The position of a leading edge having the highest possibility of becoming deviated downstream in the first directions (subscanning direction) with reference to the position of the reference leading edge is set to the first virtual leading edge. Further, the position of a leading edge having the highest possibility of becoming deviated upstream in the subscanning direction with reference to the position of the reference leading edge is set to the second virtual leading edge. Accordingly, the position of the leading edge of recording medium may become deviated or inclined within the range of feeding accuracy of the feeder and between the first and second virtual leading edges.

Since the first type of recording with the first group of nozzles is performed when an end of the first region in the upstream side of the first directions is situated at the first virtual leading edge, recording can be effected at the leading edge of the recording medium without fail and without involvement of a margin, even when the leading edge of recording medium has become most deviated. Further, recording of data within the vicinity of the leading edge of recording medium through use of only the first group of nozzles can be started as early as possible.

Since the second type of recording with all the nozzles is performed when the end of the first region in the upstream side of the first directions is situated at the second virtual leading edge, recording can be effected at the leading edge of the recording medium without fall and without involvement of a margin, even when the leading edge of recording paper has become most deviated. Further, recording of data on the vicinities of the leading edge of recording medium through use of all the nozzles can be started as early as possible.

In this way, a recording area, which is located in the vicinity of a leading edge and where throughput is deteriorated as a result of use of only a portion of all nozzles, can be minimized or set to an optimal size.

Further, the extent over which recording medium is to be transported from the time transport of fed recording paper is started until the time marginless recording operation is started can be minimized.

Therefore, a reduction in throughput, which would otherwise be caused when marginless recording is performed, can be avoided.

Preferably, the recording method further comprises the steps of:

defining a second region on the head face so as to include a second group of nozzles among all the nozzles;

defining a second amount, as an amount obtained by adding a maximum tolerance of a dimension of the recording medium in the first directions and a maximum accumulated error within a transporting tolerance of the transporter;

defining a third amount by adding the first amount and the second amount;

defining a second reference position at which a trailing edge of the recording medium is placed when the leading edge of the recording medium is placed at the first reference position;

defining a first virtual trailing edge at a position where is shifted from the second reference position to the downstream side of the first directions by the third amount;

defining a second virtual trailing edge at a position where is shifted from the second reference position to the upstream side of the first directions by the third amount;

performing a third type of recording with the second group of nozzles, when an end of the second region in the downstream side of the first directions is situated at the first virtual trailing edge; and finishing the third type of recording, when an end of the second region in the upstream side of the first directions is situated at the second virtual trailing edge.

That is, the second amount is a value which indicates the potential maximum deviation of the trailing edge of the recording medium as determined by the feeding accuracy of the feeder and the tolerance of length of the recording medium in the subscanning direction. The second amount changes according to the size of recording medium.

The position of a trailing edge having the highest possibility of becoming deviated downstream in the subscanning direction with reference to the reference position of the trailing edge is set to the first virtual trailing edge. Further, the position of a trailing edge having the highest possibility of becoming deviated upstream in the subscanning direction with reference to the reference position of the trailing edge is set to the second virtual trailing edge. Accordingly, the position of the trailing edge of recording medium may become deviated or inclined within the range of feeding accuracy of the feeder and between the first and second virtual trailing edges.

The third amount is a value which indicates the potential maximum deviation of the trailing edge of the recording medium as determined by the feeding accuracy of the feeder and the transporting accuracy of the transporter. The value changes according to the size of recording medium.

Since the third type of recording with the second group of nozzles is performed when an end of the second region in the downstream side of the first directions is situated at the first virtual trailing edge, recording can be effected at the trailing edge of the recording paper without fail and without involvement of a margin, even when the trailing edge of recording paper has become most deviated. Further, recording of data on the vicinities of the trailing edge of recording medium can be started as late as possible. In other words, recording operation-entailing use of all nozzles can be performed as long as possible.

Since the third type of recording is finished when an end of the second region in the upstream side of the first directions is situated at the second virtual trailing edge, recording can be effected at the trailing edge of the recording paper without fail and without involvement of a margin, even when the trailing edge of recording medium has become most deviated. Further, recording of data within the vicinity of the trailing edge of recording medium through use of all the nozzles can be completed as early as possible.

Accordingly, a recording area, which is located in the vicinity of a trailing edge and where throughput is deteriorated as a result of use of only a portion of all nozzles, can be minimized or set to an optimal size.

Therefore, a reduction in throughput, which would otherwise be caused when marginless recording is performed, can be avoided.

Here, it is preferable that the recording method further comprises the steps of:

detecting an actual dimension of the recording medium in the first directions;

comparing the actual dimension with a logical dimension of the recording medium in the first directions which is obtained from inputted medium size information; and updating the second reference position based on the actual dimension, when the actual dimension is smaller than the logical dimension.

In this configuration, even when the actual length of recording medium is shorter than the length of logical recording medium, recording can be completed at the trailing edge of the recording medium.

Therefore, staining of a platen, which would otherwise be caused by ejection of ink to the platen after the trailing edge of recording medium has passed by the platen, can be avoided.

Further, it is preferable that the recording method further comprises the steps of:

defining first virtual side edges at positions where both ends of the recording medium in the second directions are placed when the trailing edge of the recording medium is placed at the first virtual trailing edge;

defining second virtual side edges at positions where both ends of the recording medium in the second directions are placed when the trailing edge of the recording medium is placed at the second virtual trailing edge; and performing the first type, the second type and the third type of recording at regions situated between the first virtual side edges and the second virtual side edges.

Here, the regions situated between the first virtual side edges indicate the potential maximum deviation of the side edges of the recording medium as determined by the range of the feeding accuracy of the feeder, the transporting accuracy of the transporter, and the tolerance of length of the recording medium in the subscanning direction. The areas of the regions change according to the size of recording medium.

Since the first type, the second type and the third type of recording are performed at regions situated between the first virtual side edges and the second virtual side edges, the distance over which the recording head is to reciprocally travel in the second directions (main scanning direction) can be minimized.

Therefore, a reduction in throughput, which would otherwise be caused when marginless recording is performed, can be avoided.

Here, it is preferable that the recording method further comprises the step of preparing recording data corresponding to a region defined by the first virtual leading edge, the second virtual trailing edge, one of the first virtual side edges and one of the second virtual side edges.

Accordingly, marginless recording data can be set to a required minimum size, thereby minimizing the amount of recording data to be discarded as a result of ink being ejected outside recording medium.

According to the present invention, there is also provided a computer-readable recording medium, provided with a computer program which causes a computer to execute the above recording methods.

According to the present invention, there is also provided a recording apparatus for recording information on a recording medium without leaving any margins along at least one of four sides thereof, the apparatus comprising:

a recording region;

a feeder, which feeds the recording medium into the recording region;

a transporter, which transports the recording medium in first directions;

a recording head, having a head face formed with nozzles for ejecting ink drops onto the recording medium while being reciprocated in second directions perpendicular to the first directions; and a determinant, which defines:

a first region on the head face so as to include a first group of nozzles among all the nozzles;

a first amount, as a difference between a first reference position at which a leading edge of the recording medium situated at a recording start position is placed and a first shifted position at which the leading edge of the recording medium, which has been most shifted in the first directions and most inclined within a feeding tolerance of the feeder, is placed;

a first virtual leading edge at a position where is shifted from the first reference position to a downstream side of the first directions by the first amount; and a second virtual leading edge at a position where is shifted from the first reference position to an upstream side of the first directions by the first amount, wherein:

the recording head performs a first type of recording with the first group of nozzles, when an end of the first region in the upstream side of the first directions is situated at the first virtual leading edge; and the recording head performs a second type of recording with all the nozzles, when the end of the first region in the upstream side of the first directions is situated at the second virtual leading edge.

Preferably, the determinant defines:

a second region on the head face so as to include a second group of nozzles among all the nozzles;

a second amount, as an amount obtained by adding a maximum tolerance of a dimension of the recording medium in the first directions and a maximum accumulated error within a transporting tolerance of the transporter;

a third amount by adding the first amount and the second amount;

a second reference position at which a trailing edge of the recording medium is placed when the leading edge of the recording medium is placed at the first reference position;

a first virtual trailing edge at a position where is shifted from the second reference position to the downstream side of the first directions by the third amount; and a second virtual trailing edge at a position where is shifted from the second reference position to the upstream side of the first directions by the third amount;

the recording head performs a third type of recording with the second group of nozzles, when an end of the second region in the downstream side of the first directions is situated at the first virtual trailing edge; and the recording head finishes the third type of recording, when an end of the second region in the upstream side of the first directions is situated at the second virtual trailing edge.

Here, it is preferable that the recording apparatus further comprises:

a detector, which detects the trailing edge of the recording medium to determine an actual dimension of the recording medium in the first directions;

a comparator, which compares the actual dimension with a logical dimension of the recording medium in the first directions which is obtained from inputted medium size information; and an updater, which updates the second reference position based on the actual dimension, when the actual dimension is smaller than the logical dimension.

Further, it is preferable that the determinant defines:

first virtual side edges at positions where both ends of the recording medium in the second directions are placed when the trailing edge of the recording medium is placed at the first virtual trailing edge; and second virtual side edges at positions where both ends of the recording medium in the second directions are placed when the trailing edge of the recording medium is placed at the second virtual trailing edge; and the recording head performs the first type, the second type and the third type of recording at regions situated between the first virtual side edges and the second virtual side edges.

Here, it is preferable that the recording apparatus further comprises a data provider, which provides recording data corresponding to a region defined by the first virtual leading edge, the second virtual trailing edge, one of the first virtual side edges and one of the second virtual side edges.

Preferably, the recording apparatus further comprises a first ink receiving section, which receives ink drops ejected over the leading edge of the recording medium. A dimension of the first region in the first directions is shorter than a dimension of the first ink receiving section in the first directions by an amount which is twice a positioning tolerance of the first ink receiving section.

Further, it is preferable that the recording apparatus further comprises a second ink receiving section, which receives ink drops ejected over the trailing edge of the recording medium. A dimension of the second region in the first directions is shorter than a dimension of the second ink receiving section in the first directions by an amount which is twice a positioning tolerance of the second ink receiving section.

Still further, it is preferable that the recording apparatus further comprises third ink receiving sections, which receive ink drops ejected over the side edges of the recording medium. A dimension of each region between the first virtual side edge and the second virtual side edge in the second directions Is shorter than a dimension of each of the third ink receiving sections in the second directions by an amount which is twice a positioning tolerance of the third ink receiving sections.

In the above configurations, ink ejected over the four side edges of the recording medium can be surely received by the respective ink receiving sections.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the invention will be described hereinbelow by reference to the accompanying drawings.

Figure 1:
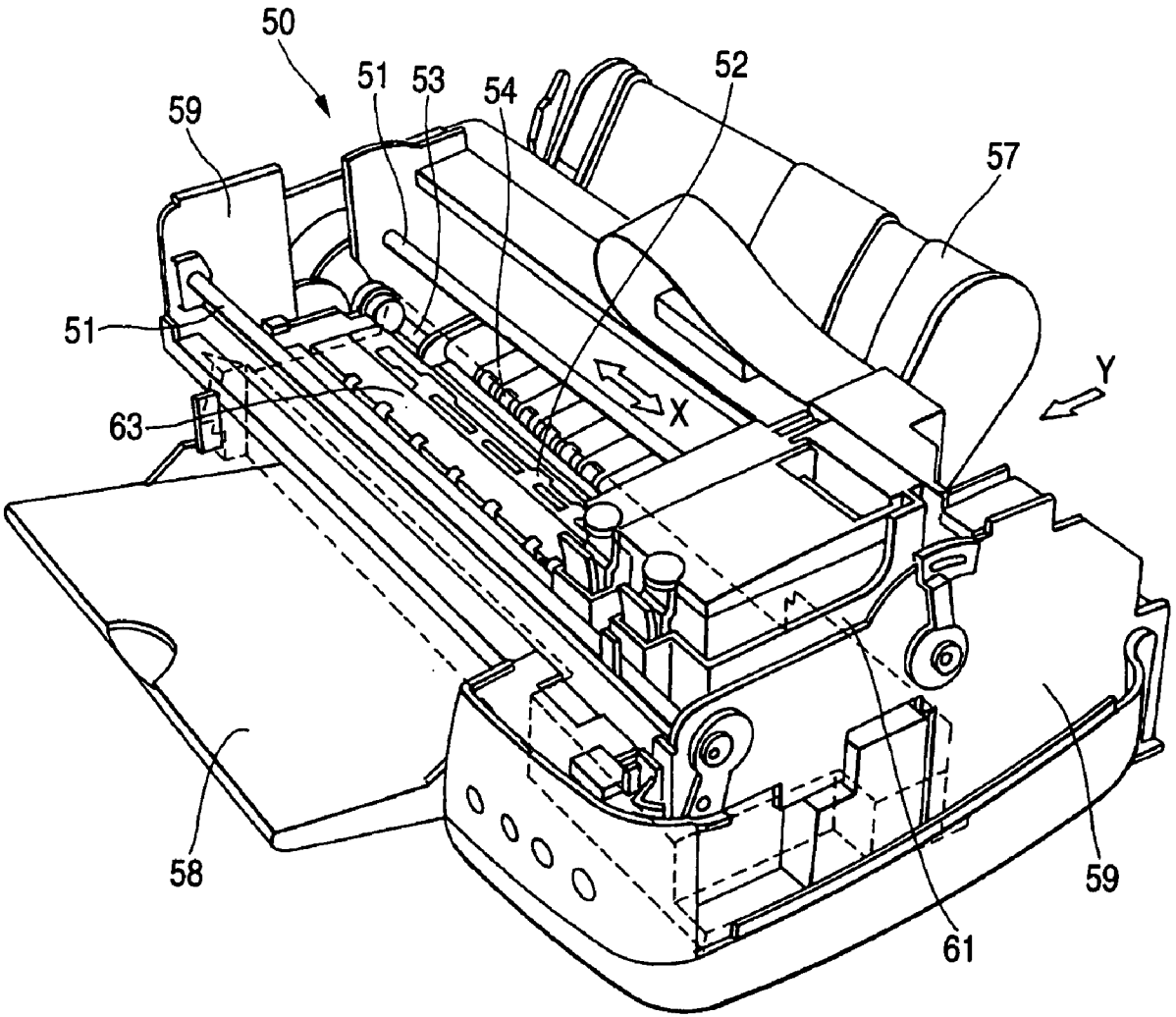
FIG. 1 is a schematic perspective view showing an ink jet recording apparatus according to a first embodiment of the invention.

First, the schematic configuration of an ink jet recording apparatus serving as a "recording apparatus" of the invention will be described with reference to FIGS. 1 and 2.

An ink jet recording apparatus 50 is provided with a carriage 61 for effecting recording operation by ejecting Ink 10 to a recording surface of recording paper P, such as plain paper or paper specifically designed for photographic recording, wherein the carriage 61 is supported by two carriage guide shafts 51 attached to a housing 59 and translates in a main scanning direction X. The carriage 61 carries a recording head 62 for ejecting the ink 10 to the recording paper P. A platen 52 for specifying paper gap (paper gap) between a head surface 62*a* of the recording head 62 and the recording paper P is disposed so as to oppose the recording head 62. Recording of data onto the recording paper P is performed, by causing the carriage 61 to translate in the main scanning direction X and transporting the recording paper P in a subscanning direction Y between the carriage 61 and the platen 52.

The ink jet recording apparatus 50 is provided with an unillustrated automatic paper feeder having a configuration capable of feeding the recording paper P. Here, the automatic paper feeder has an unillustrated paper feed roller and an unillustrated separation pad. When a plurality of sheets of recording paper P loaded on a paper feed tray 57 are fed, the plurality of sheets of recording paper P are automatically and accurately fed one by one without all the sheets of recording paper P being fed at one type, by rotational driving force of the paper feed roller and frictional resistance of the separation pad.

The ink jet recording apparatus 50 is provided a transport drive roller 53 and a transport follower roller 54 serving as a recording paper transporter for intermittently transporting the fed recording paper P in the subscanning direction Y. The transport drive roller 53 is rotationally controlled by the source of rotational driving force. The recording paper P is transported in the subscanning direction Y by rotation of the transport drive roller 53. A plurality of transport follower rollers 54 are provided and individually pressed against the transport drive roller 53. When the recording paper P is transported by rotation of the transport drive roller 53, the transport follower rollers 54 come into contact with the recording paper P, thereby rotating so as to follow transport of the recording paper P.

An unillustrated paper sensor 64 of known technique is interposed between the paper feed roller and the transport drive roller 53. The paper sensor 64 is imparted with a characteristic of self-restoration to a standing position. The paper sensor 64 is provided with a lever which is supported so as to be able to rotate in only the recording paper transport direction while projecting to the inside of a transport path of the recording paper P. As a result of the extremity of the lever being pushed by the recording paper P, the lever is pivoted, whereby the recording paper P is detected.

The ink jet recording apparatus 50 is provided with a discharging drive roller 55 and a discharging follower roller 56 serving as a paper discharger discharges the recorded recording paper P. The discharging drive roller 55 is rotationally controlled by the source of rotational driving force. By the rotation of the discharging drive roller 55, the recording paper P is discharged in the subscanning direction Y. A plurality of discharging follower rollers 56 are provided on a discharging frame 63. Each of the discharging follower rollers 56 is a toothed roller having a plurality of teeth provided therearound, wherein the ends of the teeth are sharpened acutely so as to come into point contact with a recording surface of the recording paper P. The discharging follower rollers 56 are pressed individually against the discharging drive roller 55 and driven with force smaller than that required for pressing the transport follower rollers 54. When the recording paper P is discharged by the rotation of the discharging drive roller 55, the discharging follower rollers 56 rotate so as to follow the discharge of the recording paper P while coming into contact with the recording paper P. The recording paper P is discharged to a discharging tray 58.

A plurality of ribs 521 are provided in the platen 52 for regulating a distance between the head surface 62*a* of the recording head 62 and a recording surface of the recording paper P and for guiding the recording paper P in the subscanning direction Y. Further, a trailing-edge ink-receiving section 522 and a leading-edge ink-receiving section 523 are formed in the platen 52. The trailing-edge ink-receiving section 522 receives over-spray ink 10 which is discarded when the vicinity of the leading edge of the recording paper P is subjected to recording during the course of data being recorded on the recording paper P without providing the four sides thereof with margins. The leading-edge ink-receiving section 523 receives the over-spray ink 10 which is discarded when the vicinity of the leading edge of the recording paper P is subjected to recording. The ink 10 that has been discarded to the trailing-edge ink-receiving section 522 and the leading-edge ink-receiving section 523 is guided by ink guide grooves 524 to an ink discharging channel 525. The thus-guided ink flows into a waste ink reservoir 526 and is absorbed by an ink-absorbing material 527 provided in the ink reservoir 526.

In relation to the marginless recording of the invention, there will now be described an area in which recording is performed through use of only a group of nozzles for leading-marginless recording purpose and an area in which recording is performed through use of only a group of nozzles for trailing-marginless recording purposes, both of which are determined before the recording is executed.

Figure 3:
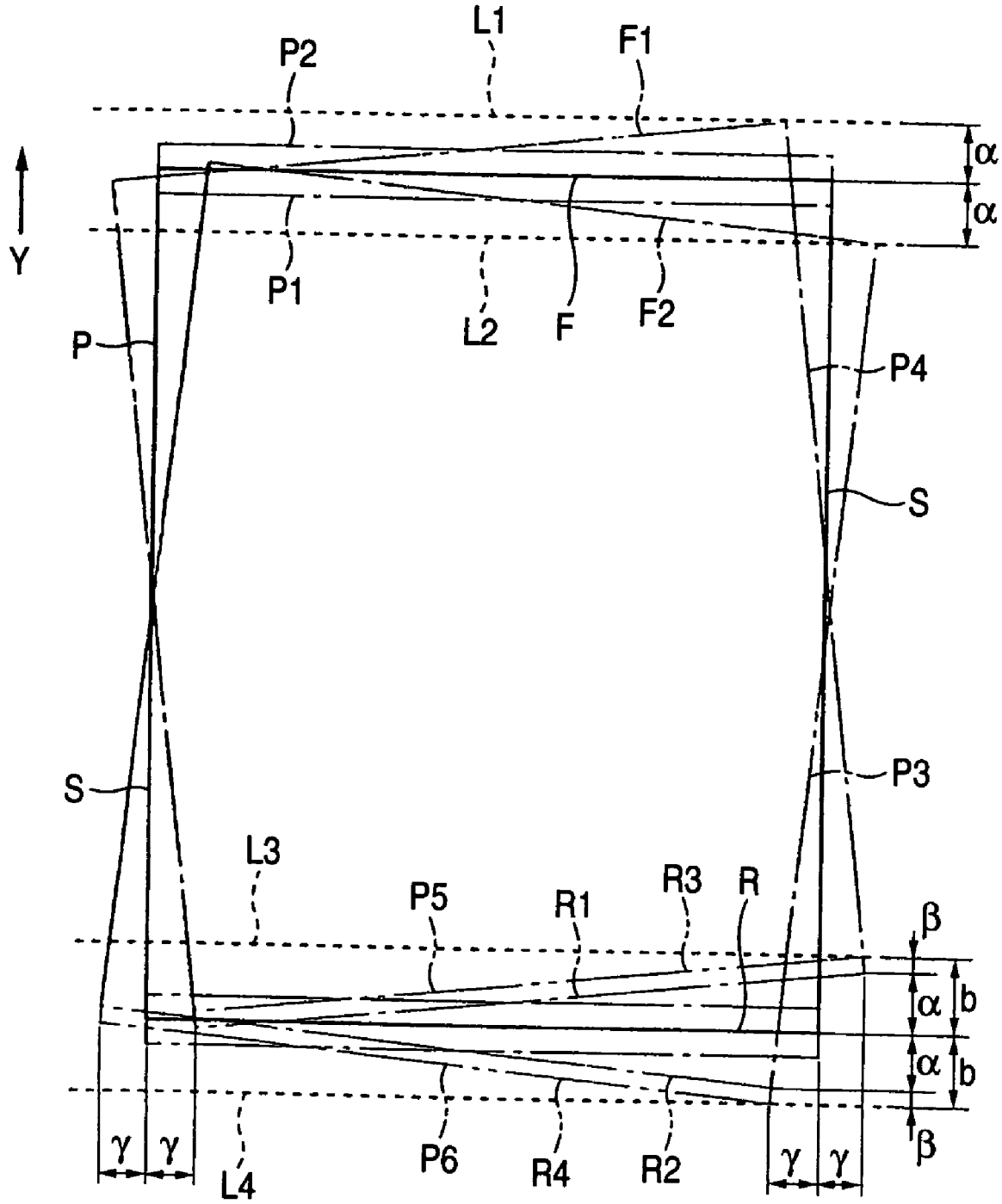
FIG. 3 is a plan view schematically showing a reference position of recording paper and positions most deviated and inclined from the reference position.

FIG. 3 is a plan view schematically showing a reference position of the recording paper P in terms of the paper feed accuracy of the automatic paper feeder and the transport accuracy of the recording paper transporter, both pertaining to the ink jet recording apparatus 50 of the invention, and within the tolerance of recording length of the recording paper P, as well as showing positions of the recording paper which is most deviated and inclined from the reference position.

Recording paper P1 shows a state in which the recording paper P serving as a reference has become most deviated upstream In the subscanning direction Y within the range of paper feed accuracy of the automatic paper feeder. Recording paper P3 shows a state in which the recording paper P1 has become most inclined within the range of paper feed accuracy of the automatic paper feeder. Recording paper P2 shows a state in which the recording paper P serving as a reference has become most deviated downstream in the subscanning direction Y within the range of paper feed accuracy of the automatic paper feeder. Recording paper P4 shows a state in which the recording paper P2 has become most inclined within the range of paper feed accuracy of the automatic paper feeder.

The maximum difference between a leading edge F1 of the recording paper P3 and another leading edge F of the recording paper P is equal to that existing between a leading edge F2 of the recording paper P4 and a leading edge F of the recording paper P. The maximum difference is set to a paper feed error level $\alpha$. There is set a first virtual leading edge position L1 to which the leading edge F of the recording paper P has been deviated downstream in the subscanning direction Y by only an amount corresponding to the paper feed error level $\alpha$. There is set a second virtual leading edge position L2 to which the leading edge F of the recording paper P has been deviated upstream in the subscanning direction Y by only an amount corresponding to the paper feed error level $\alpha$.

Recording paper P5 shows a state in which the trailing edge of the recording paper P4 has become most deviated downstream in the subscanning direction Y within the transport accuracy of the recording paper transporter and the tolerance of length of recording paper. Recording paper P6 shows a state in which the trailing edge of the recording paper P3 has become most deviated upstream in the subscanning direction Y within the transport accuracy of the recording paper transporter and the tolerance of length of recording paper.

The maximum difference between a trailing edge R1 of the recording paper P4 and another trailing edge R3 of the recording paper P5 is equal to that existing between a trailing edge R2 of the recording paper P3 and a trailing edge R4 of the recording paper P6. The maximum difference is set to a transport error level $\beta$. There is set a first virtual trailing edge position L3 to which the trailing edge R of the recording paper P has been deviated downstream in the subscanning direction Y by only an amount (reference symbol "b") yielded by addition of the transport error level β to the paper feed error level α. There is set a second virtual trailing edge position L4 to which the trailing edge R of the recording paper P has been deviated upstream in the subscanning direction Y by only an amount yielded by addition of the transport error level β to the paper feed error level α.

Figure 4:
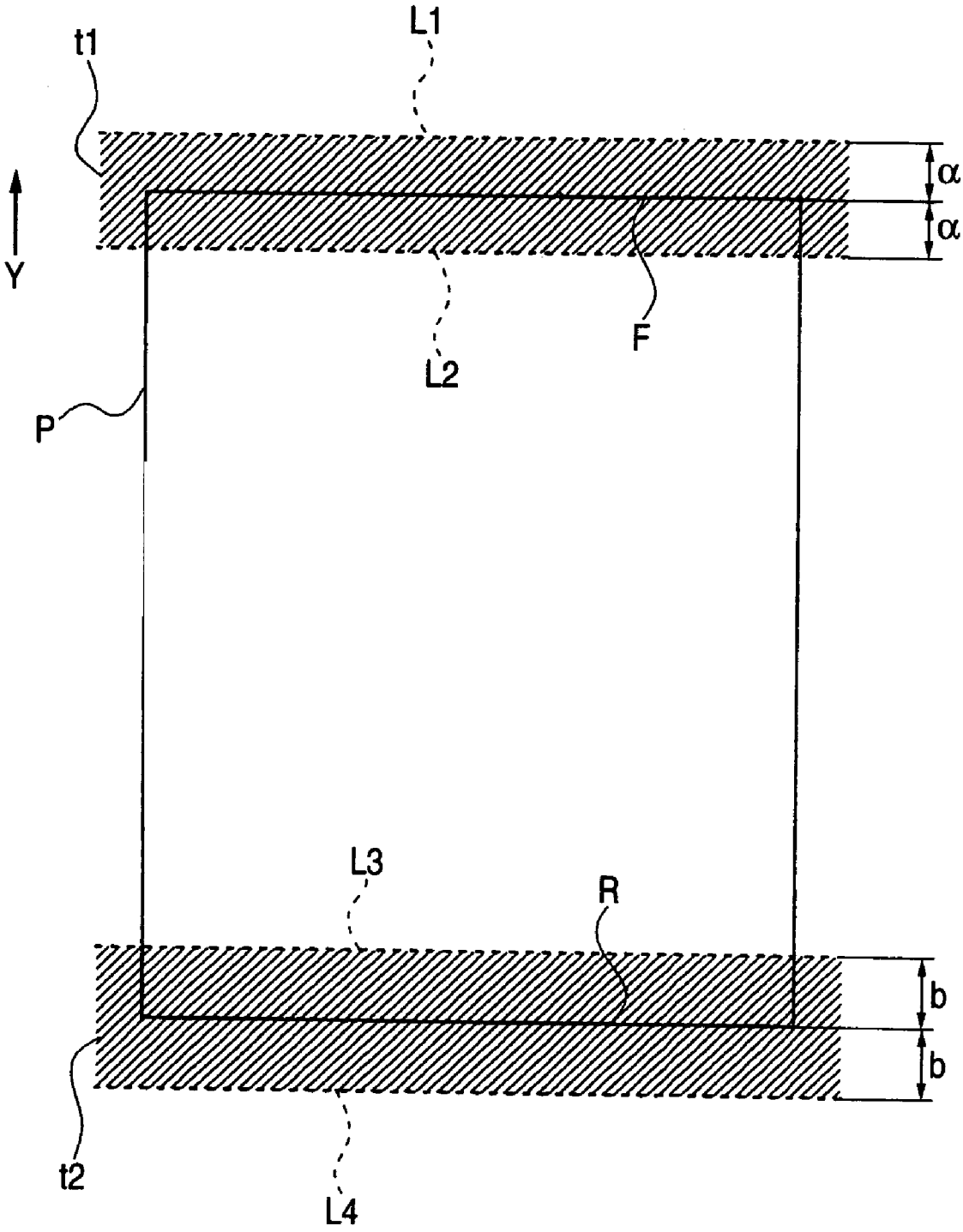
FIG. 4 is a plan view schematically showing an area in which recording is performed by use of a group of nozzles for leading-marginless recording purpose and an area in which recording is performed by use of a group of nozzle for trailing-marginless recording purpose.

The maximum distance between a side edge S of the recording paper P and the side edge of the recording paper P5 is set to a maximum side edge deviation level γ. The same also applies to a case where the maximum deviation between the side edge of the recording paper P and the side edge of the recording paper P6 is set to the maximum side edge deviation level γ. FIG. 4 is a plan view schematically showing a state that an area in which recording is performed by use of a group of nozzles for leading-marginless recording purpose and an area in which recording is performed by use of a group of nozzle for trailing-marginless recording purpose are determined.

As mention previously, the first virtual leading edge position L1 has the highest possibility of becoming deviated downstream in the subscanning direction Y with reference to the position of a logical leading edge (i.e., the leading edge F of the recording paper P). The second virtual leading edge position L2 has the highest possibility of becoming deviated upstream In the subscanning direction Y with reference to the position of a logical leading edge (i.e., the leading edge F of the recording paper P). Accordingly, the leading edge F of the recording paper P has the possibility of becoming inclined or deviated between the first and second virtual leading edge positions L1 and L2 within the range of paper feed accuracy of the automatic paper feeder. Consequently, an area which is designated by reference numeral t1 and is located between the first virtual leading edge position L1 and the second virtual leading edge position L2 becomes an area in which recording is performed by use of only a group of nozzles for leading-marginless recording purposes.

A first virtual trailing edge position L3 has the highest possibility of becoming deviated downstream in the subscanning direction Y with reference to the logical trailing edge position (i.e., the trailing edge R of the recording paper P). Further, a second virtual trailing edge position L4 has the highest possibility of becoming deviated upstream in the subscanning direction Y with reference to the logical trailing edge position (i.e., the trailing edge R of the recording paper P). The trailing edge R of the recording paper P has the possibility of becoming deviated or inclined between the first and second virtual trailing edge positions L3 and L4 within the range of paper feed accuracy of the automatic paper feeder, the range of transport accuracy of the recording paper transporter, and the tolerance range of length of the recording paper. Therefore, an area which is designated by reference numeral t2 and is located between the first virtual trailing edge position L3 and the second virtual trailing edge position L4 is an area where recording is performed by use of only a group of nozzles for trailing-marginless recording purposes.

Processes in which the marginless recording is performed on the recording paper P will now be described with reference to FIGS. 5 through 10.

Figure 5:
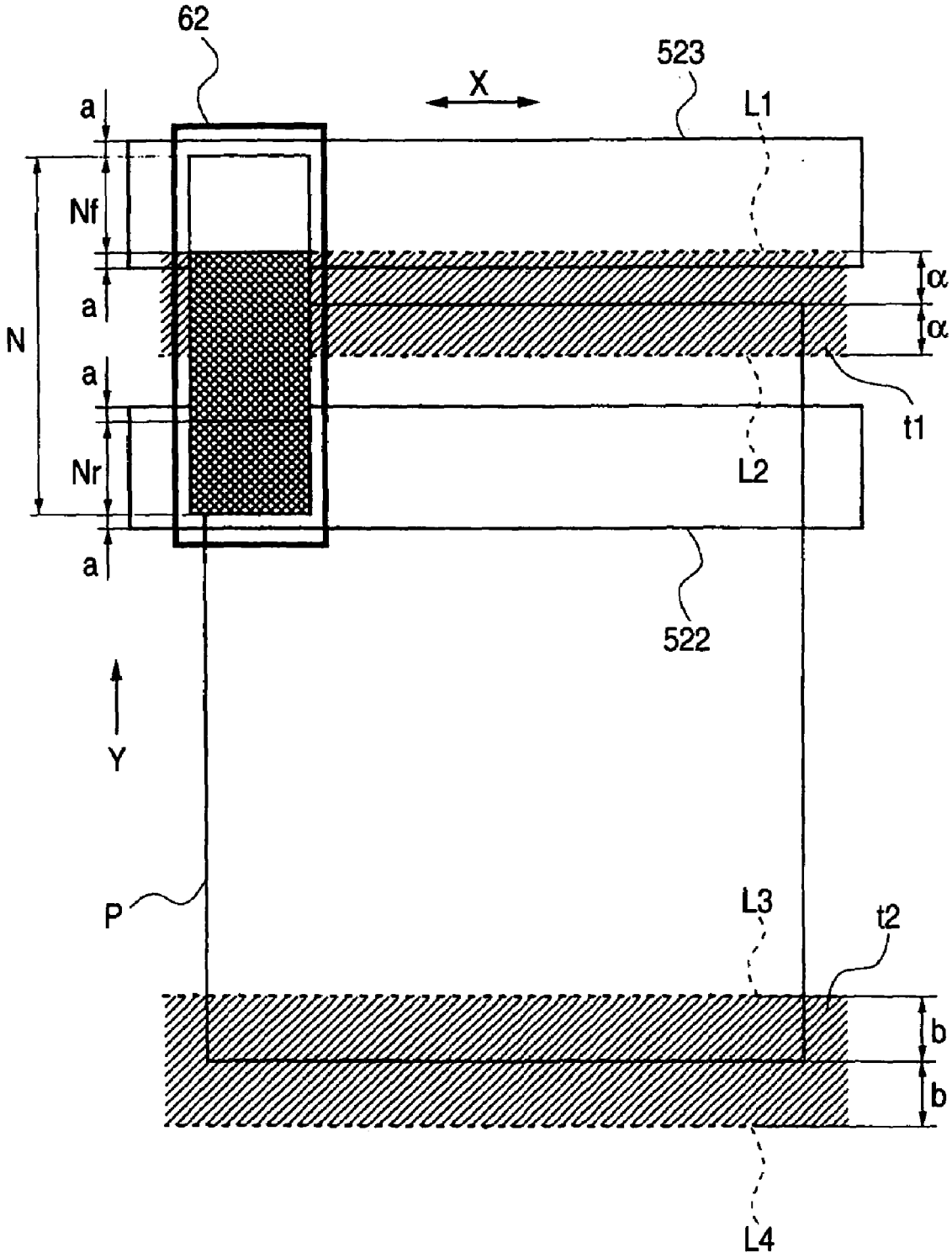
FIG. 5 is a plan view schematically showing a state in which recording in the vicinity of the leading edge of the recording paper through use of only the group of nozzles for leading-marginless recording purpose is started.
Figure 6:
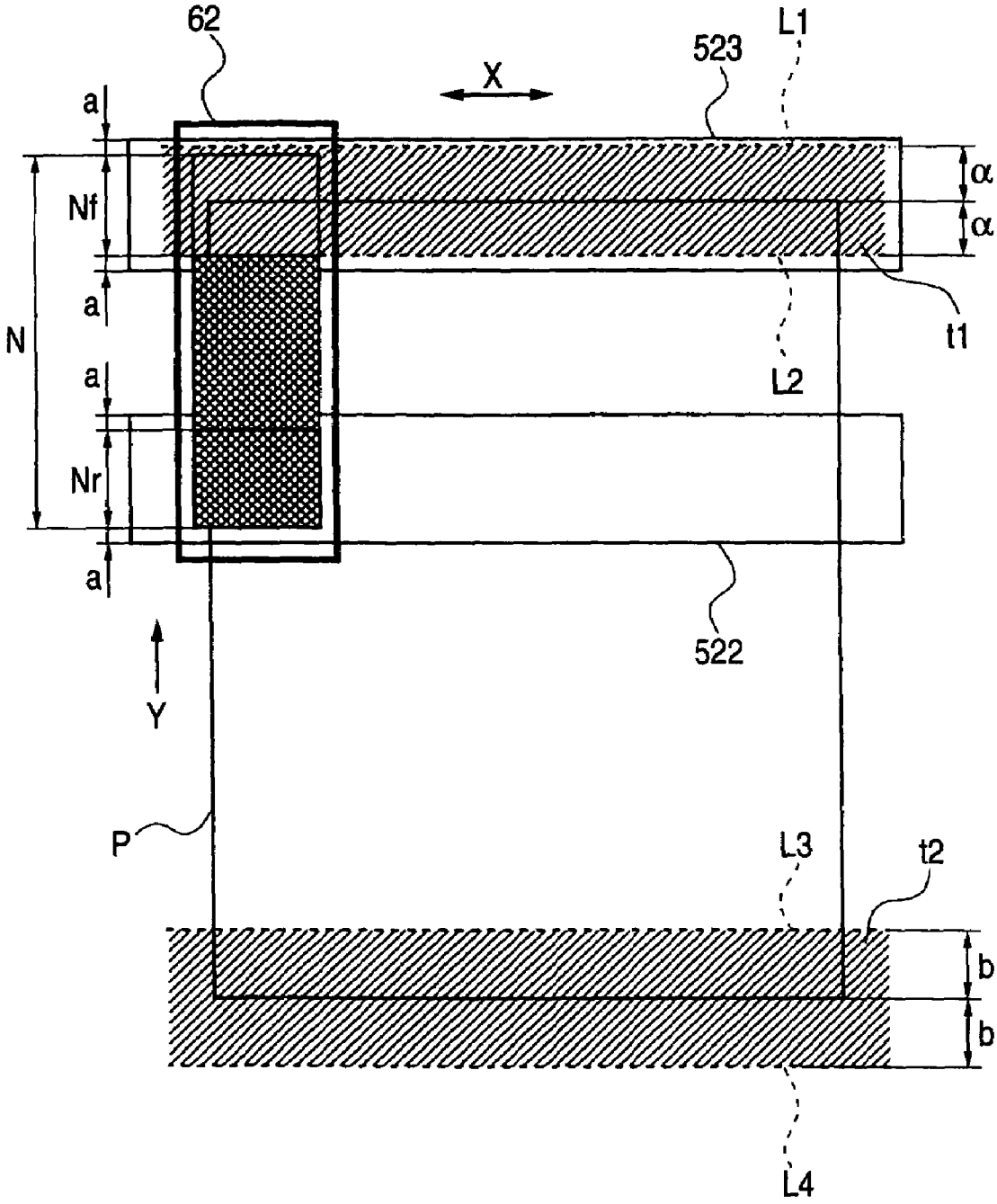
FIG. 6 is a plan view schematically showing a state in which the marginless recording within the vicinity of the leading edge of the recording paper is finished.
Figure 7:
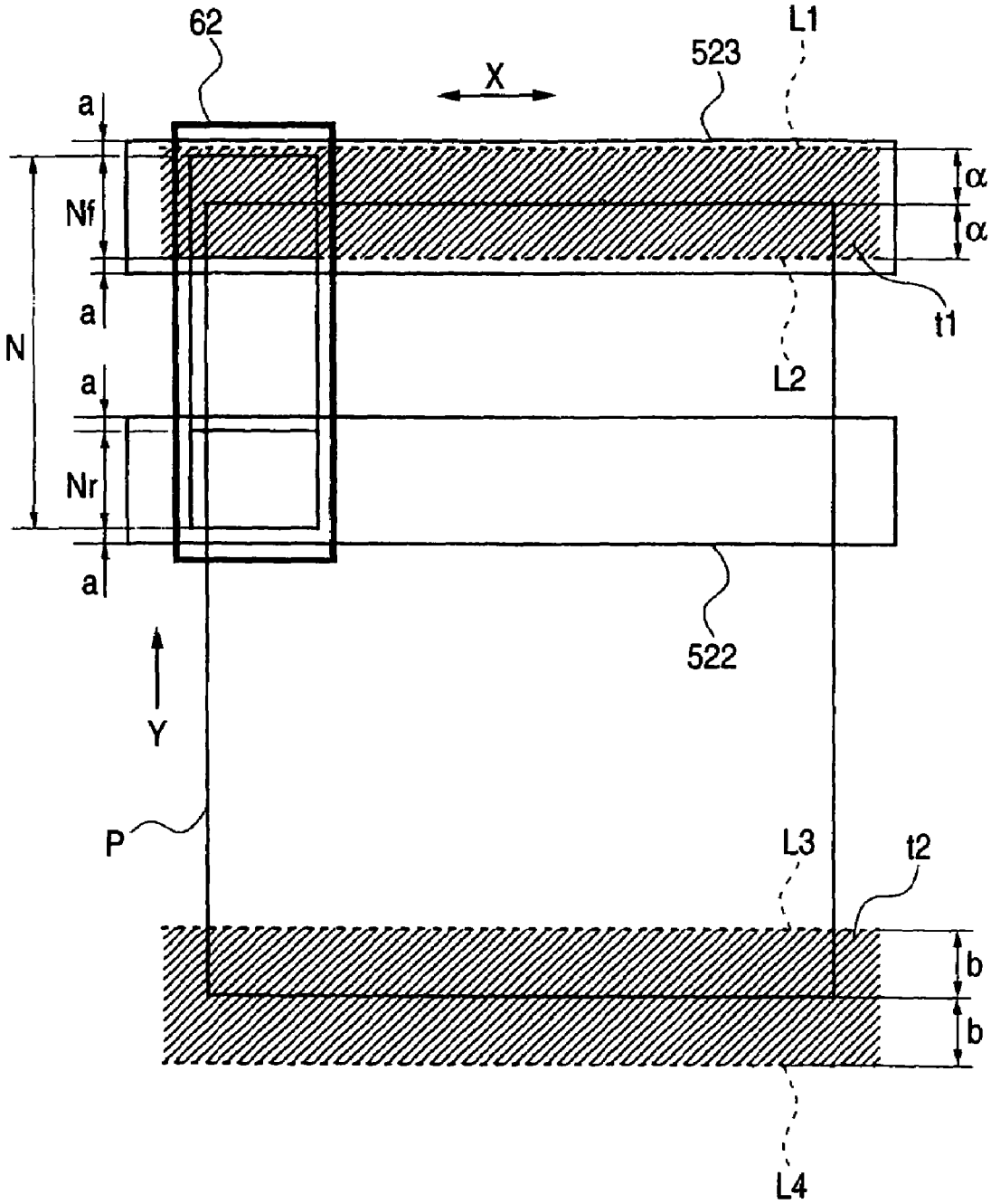
FIG. 7 is a plan view schematically showing a state in which recording through use of all the nozzles of the group is started.
Figure 8:
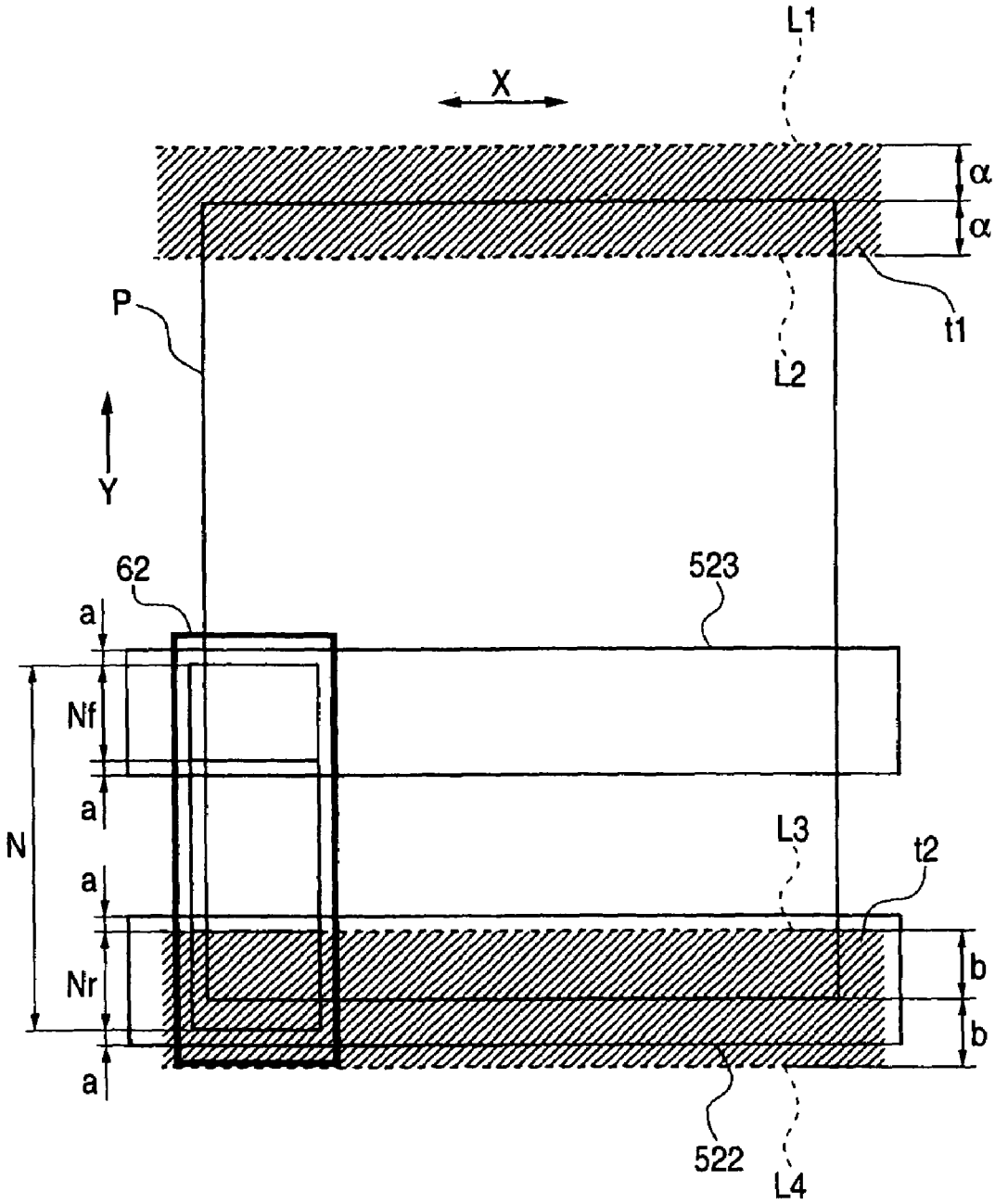
FIG. 8 is a plan view schematically showing a state in which the recording through use of all the nozzles of the group is finished.
Figure 9:
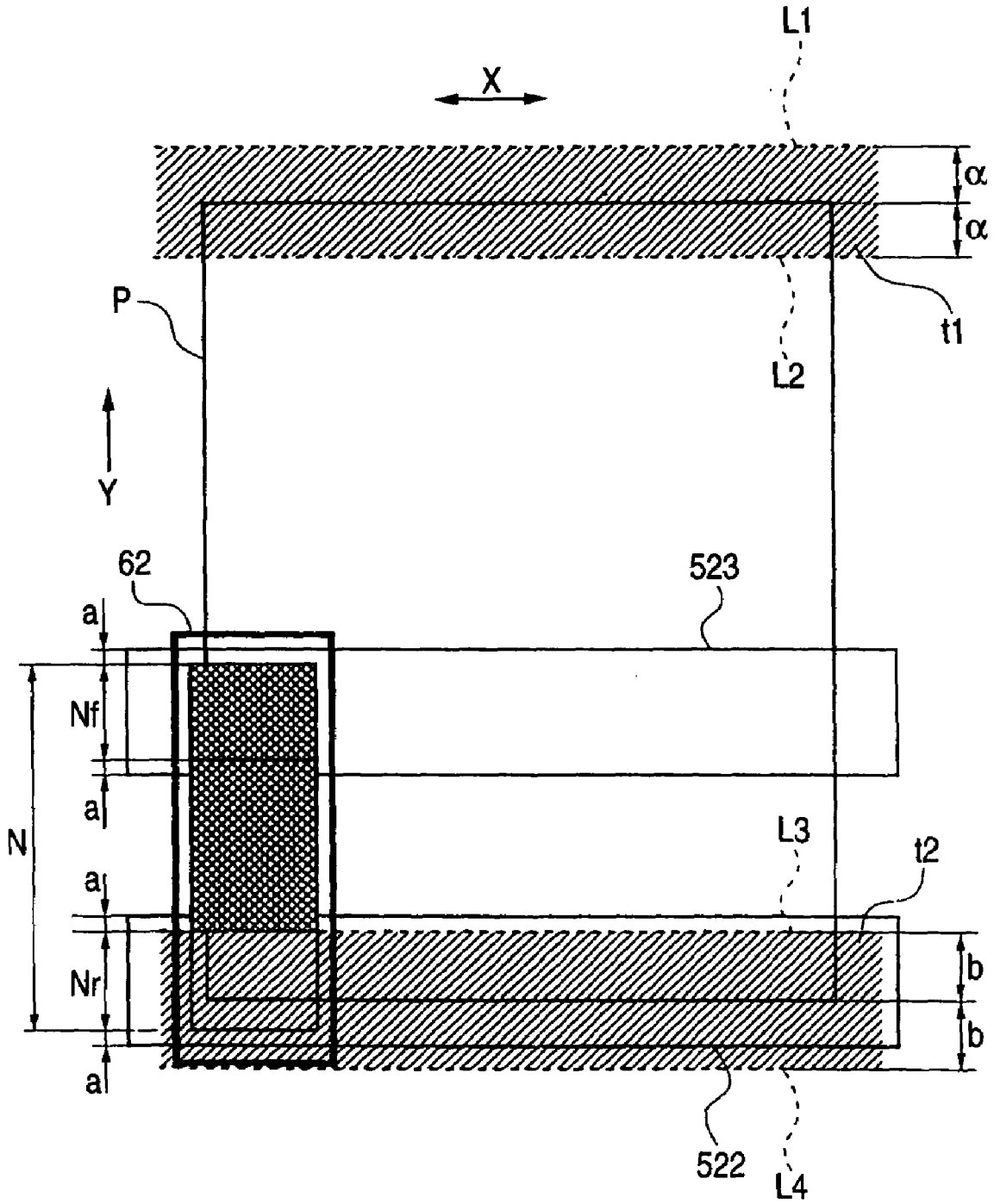
FIG. 9 is a plan view schematically showing a state in which the recording in the vicinity of the trailing edge of recording paper through use of only the group of nozzles for trailing-marginless recording purpose is started.

As shown in FIG. 5, among all nozzles of the group N provided on the recording head 62, a group of nozzles capable of over-spraying the ink 10 to the leading edge ink-receiving section 523 is set as a group of nozzles for leading-marginless recording purpose Nf. As illustrated, provided the maximum difference between the recording head 62 and the leading-edge ink-receiving section 523, which is due to manufacturing tolerance, is set to an error "a," the group of nozzles Nf can be set within a range which is offset from both sides in the subscanning direction Y of the leading-edge ink-receiving section 523 by an amount corresponding to the error "a." As a result, when the ink 10 is ejected through use of only the group of nozzles Nf for leading-marginless recording purposes, all the ink 10 sprayed outside the recording paper P can be discarded into the leading-edge ink-receiving section 523. The range set for the group of nozzles Nf of all the nozzles of the group N is preferably set to the largest possible extent, thereby improving marginless recording throughput. In the embodiment, the range that is defined in the width of the leading-edge ink-receiving section 523 and offset from both sides in the subscanning direction Y thereof by only an amount corresponding to the error "a" is set to the group of nozzles Nf for leading-marginless recording.

Among all the nozzles of the group N provided on the recording head 62, a group of nozzles capable of spraying the ink 10 into the trailing-edge ink-receiving section 522 are set to a group of nozzles Nr for trailing-marginless recording purposes. Provided that the maximum difference between the recording head 62 and the position of the trailing-edge ink-receiving section 522, which is due to manufacturing tolerance, is set to the error "a" as in the case of the leading-edge ink-receiving section 523, the group of nozzles Nr for trailing-marginless recording purpose can be set within the group of nozzles defined in the trailing-edge ink-receiving section 522 and offset from both sides in the subscanning direction Y thereof by the error "a." As a result, when the ink 10 is ejected through use of only the group of nozzles Nr for trailing-marginless recording purpose, all the ink 10 sprayed outside the recording paper P can be discarded into the trailing-edge ink-receiving section 522.

As in the case of the group of nozzles Nf for leading-marginless recording purpose, the range set for the group of nozzles Nf should preferably be set to the largest possible extent, thereby improving marginless recording throughput. In the embodiment, the entire range defined in and offset from both sides in the subscanning direction Y of the trailing-edge ink-receiving section 522 is set for the group of nozzles Nr for trailing-marginless recording purpose.

When recording operation is performed after the group of nozzles Nf for leading-marginless recording purposes and the group of nozzles Nr for trailing-marginless recording purposes have been determined, the recording paper P is fed from the automatic paper feeder in the subscanning direction Y such that the leading edge of the recording paper P reaches a recording start position. Next, the recording paper P is transported by the recording paper transporter at a predetermined transport rate in the subscanning direction Y. When the first virtual leading edge position L1 has reached the nozzle that is located in the most upstream position on the group of nozzles Nf for leading-marginless recording purposes with respect to the subscanning direction (the transport position of the recording paper P shown in FIG. 5), recording is performed in the area which is designated by reference numeral t1 and situated between the first and second virtual leading edge positions L1 and L2.

As a result, even when the leading edge F of the recording paper P has become most deviated downstream in the subscanning direction Y, recording can be performed at the leading edge F of the recording paper P without fail and without involvement of margins. Recording of data within the vicinity of the leading edge of the recording paper P through use of only the group of nozzles Nf for leading-marginless recording purposes can be started at the earliest. In the drawing, the group of hatched nozzles from among all the nozzles of the group N are those which are not used during recording. The same also applies to the following drawings.

When the second virtual leading edge position L2 has reached the position of nozzles located at the most upstream position in the subscanning direction Y of the group of nozzles Nf for leading-marginless recording (the position of the recording paper P shown in FIG. 6), recording operation using only the group of nozzles Nf is completed, and recording operation is performed through use of all the groups of nozzles N. As a result, even when the leading edge F of the recording paper P has become most deviated upstream in the subscanning direction Y, recording can be performed on the leading edge F of the recording paper P without fail and without involvement of margins. Recording of data within the vicinity of the leading edge of the recording paper P through use of all the nozzles of the group N can be started as early as possible.

When recording of data onto the area which is designated by reference numeral t1 and located between the first and second virtual leading edge positions L1 and L2 has been completed by use of only the group of nozzles Nf for leading-marginless recording purposes (i.e., the position of the recording paper P shown in FIG. 7), recording is performed while all the nozzles of the group N are set as a group of nozzles to be used.

When the first virtual trailing edge position L3 has reached the position of nozzles located at the most downstream position in the subscanning direction Y of the group of nozzles Nf for trailing-marginless recording (the position of the recording paper P shown in FIG. 8), recording operation using all the nozzles of the group N is completed.

When the first virtual trailing edge position L3 has reached the position of nozzles disposed at the most downstream position in the subscanning direction Y of the group of nozzles Nr for trailing-marginless recording purpose (i.e., the position of the recording paper P shown in FIG. 9), recording is performed through use of only the group of nozzles Nr for trailing-marginless recording purposes. As a result, even when the trailing edge R of the recording paper P has become most deviated downstream in the subscanning direction Y, recording can be performed on the trailing edge R of the recording paper P without fail and without involvement of margins. Recording of data within the vicinity of the trailing edge of the recording paper P through use of only the group of nozzles Nr for trailing-marginless recording purposes can be started as late as possible. In other words, recording using all the nozzles can be performed as long as possible.

Figure 10:
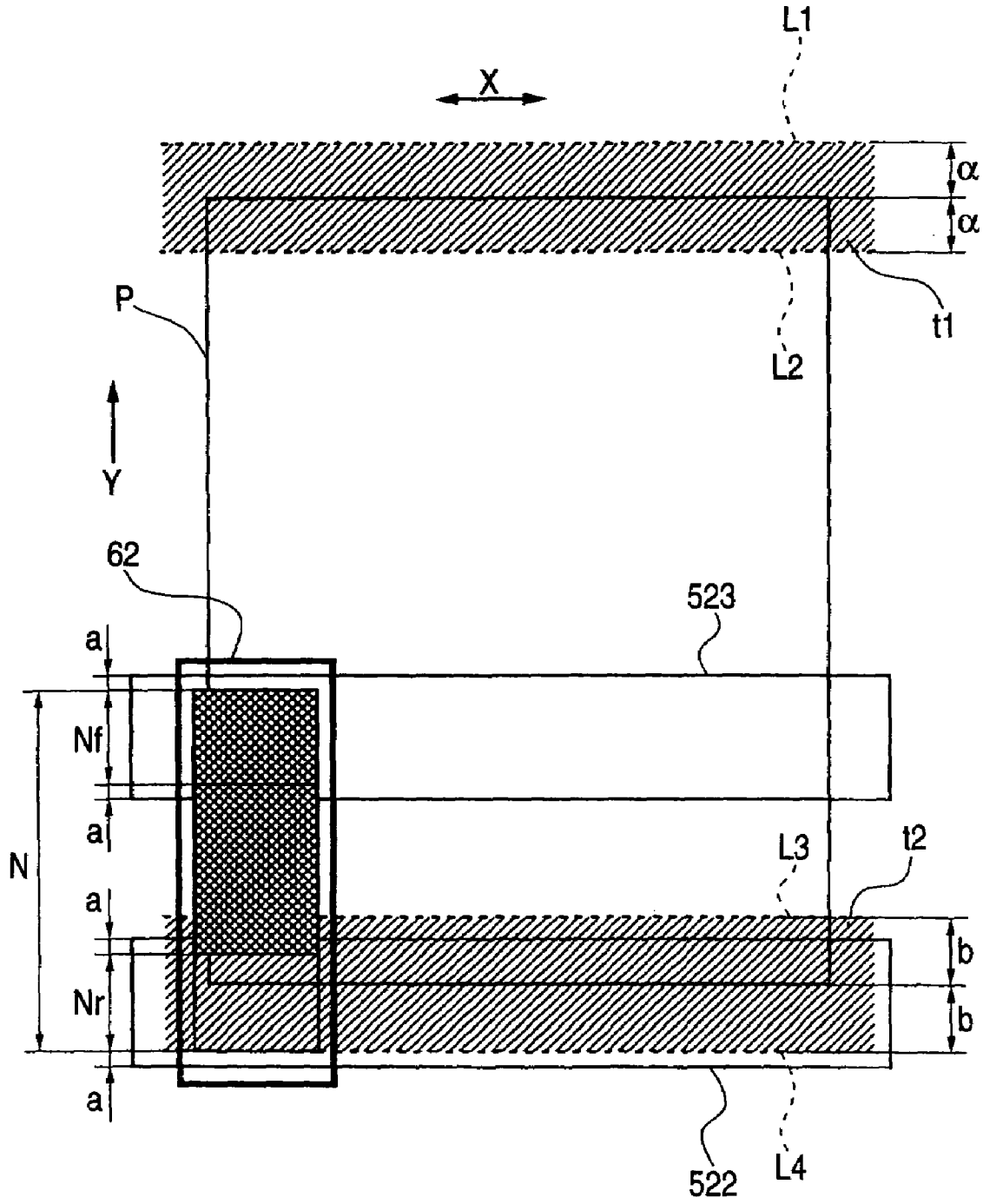
FIG. 10 is a plan view schematically showing a state in which the recording in the vicinity of the trailing edge of the recording paper through use of only the group of nozzles for trailing-marginless recording purposes is finished.

When the second virtual trailing edge position L4 has reached the position of nozzles disposed at the most upstream position in the subscanning direction Y of the group of nozzles Nr for trailing-marginless recording purpose (i.e., the transport position of the recording paper P shown in FIG. 10), recording is completed. As a result, even when the trailing edge R of the recording paper P has become most deviated upstream in the subscanning direction Y, recording can be performed on the trailing edge R of the recording paper P without fail and without involvement of margins. Recording of data within the vicinity of the trailing edge of the recording paper P through use of only the group of nozzles Nr for trailing-marginless recording purposes can be completed as early as possible.

In this way, recording is performed only within a domain defined between the first and second virtual leading edge positions L1 and L2, at which the leading edge of recording paper may become deviated or inclined within the range of paper feed accuracy of the automatic paper feeder, and through use of only the group of nozzles Nf corresponding to an area in which ink can be over-sprayed when the vicinity of the leading edge of the recording paper is subjected to marginless recording, from among all the nozzles of the nozzle group N. As a result, a recording area, which is located in the vicinity of a leading edge and where throughput is deteriorated as a result of use of only a portion of all nozzles, can be minimized or set to an optimal size.

In this way, recording is performed only within a domain defined between the first and second virtual trailing edge positions L3 and L4, at which the trailing edge of recording paper may become deviated or inclined within the range of paper feed accuracy of the automatic paper feeder, and through use of only nozzles Nr corresponding to an area in which ink can be over-sprayed when the vicinity of the trailing edge of the recording paper is subjected to marginless recording, from among all the nozzles of the nozzle group 10. As a result, a recording area, which is located in the vicinity of a trailing edge and where throughput is deteriorated as a result of use of only a portion of all nozzles N, can be minimized or set to an optimal size.

Recording of data within the vicinity of the trailing edge of recording paper through use of only the group of nozzles Nf for leading-marginless recording purposes can be started as early as possible. Further, recording of data within the vicinity of the leading edge of recording paper through use of all the nozzles N can be started as early as possible. Therefore, the distance over which the recording head is to reciprocally travel from the time transport of the fed recording paper P is started until marginless recording operation is started can be minimized. Further, recording of data within the vicinity of the trailing edge of recording paper P through use of only the group of nozzles Nr for trailing-marginless recording purposes can be started as late as possible and completed as early as possible. Hence, the time during which data are recorded within the vicinity of the trailing edge of the recording paper through use of only the group of recording nozzles Nr for trailing-marginless recording purposes can be minimized.

The marginless recording in this embodiment can be embodied by a controller which is provided in the ink jet recording apparatus 50 and constituted of a hardware circuit. Alternatively, the marginless recording may be embodied as a software program to be executed by a controller which is constituted of a CPU or a microcomputer provided in the ink jet recording apparatus 50.

There will be described a second embodiment of the invention in which an over-spray ink area provided on both sides of the recording paper P is minimized, in addition to the configuration of the first embodiment.

Figure 11:
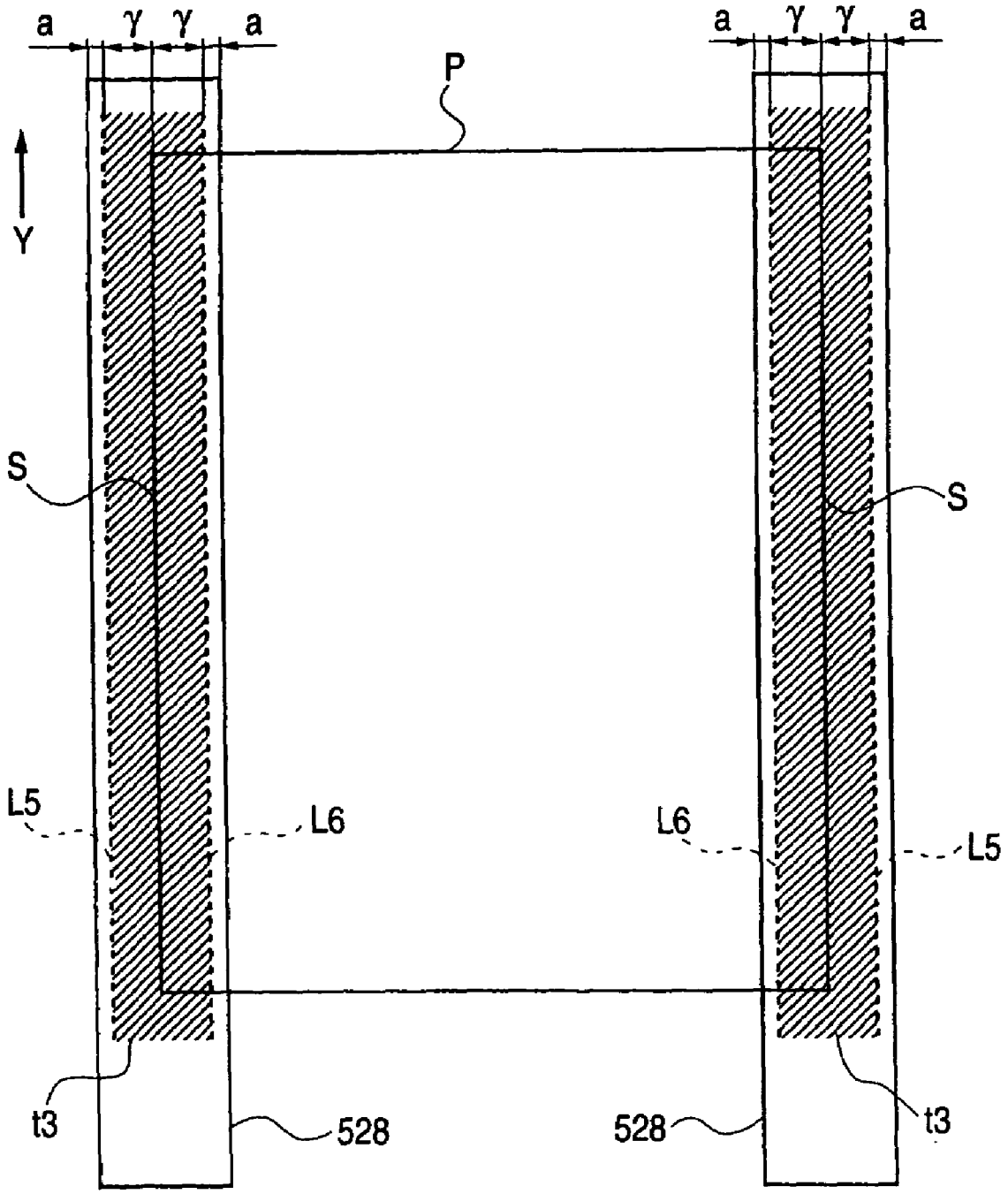
FIG. 11 is a plan view schematically showing a method of performing marginless recording according to a second embodiment of the invention.

As shown in FIG. 11, a first virtual side edge position L5, which is defined by offsetting the side edge S of the recording paper P serving as a reference to the outside of the recording paper P by only an amount corresponding to the maximum side edge deviation level $\gamma$ (FIG. 3), is determined on each side edge, thereby setting the width of a first virtual side edge L5 to the width of virtual recording paper. Recording in the main scanning direction X is performed over the width of the virtual recording paper, so that a swath over which the recording head 62 is to scan during marginless recording operation can be minimized. As a result, even when the side edge S of the recording paper P is most inclined, recording is performed without providing both side edges S of the recording paper P with margins, thereby diminishing a drop in throughput during marginless recording operation.

The platen 52 (shown in FIG. 2) has side-edge ink-receiving section 528 for receiving the ink 10 sprayed outside the recording paper P when recording is performed in the vicinities of both side edges S of the recording paper P. The side-edge ink-receiving sections 528 are disposed in the vicinities of both side edges S of the recording paper P and located at positions which change in accordance with the size of recording paper. The ink 10 discarded to the side-edge ink-receiving sections 528 is guided to the ink guide grooves 524 and further to the ink discharging channel 525, thereby flowing into the waste ink reservoir 526. The ink is absorbed in the ink absorbing material 527 provided in the waste ink reservoir 526.

A second virtual side edge position L6, which is defined by offsetting the side edge S of the recording paper P serving as a reference to the inside of the recording paper P by only an amount corresponding to the maximum side edge deviation level $\gamma$, is set on each side edge, thereby setting an area (t3) between the first virtual side edge position L5 and the second virtual side edge position L6. In short, the side edge having the possibility of becoming most deviated outside is set to the first virtual side edge L5, and the side edge having the possibility of becoming most deviated inside is set to the second virtual side edge L6. The side edges of the recording paper P have the possibility of becoming deviated or inclined within the range defined between the first and second virtual side edges L5 and L6.

Therefore, the maximum deviation between the recording head 62 and the side-edge ink-receiving sections 528, which is due to manufacturing tolerance, is taken as an error "a." Each of the side-edge ink-receiving section 528 is disposed such that both side edges thereof in the main scanning direction X are offset from the first virtual side edge L5 and the second virtual side edge L6 of the area t3 by only an amount corresponding to the error "a." Hence, the width of the side-edge ink-receiving sections 528 can be set to a minimal value, wherein each of the ink receiving sections 528 has a width which enables recording without fail and without providing the side edges S of the recording paper P with margins even when the side edge S of the recording paper P has become most deviated.

Figure 2:
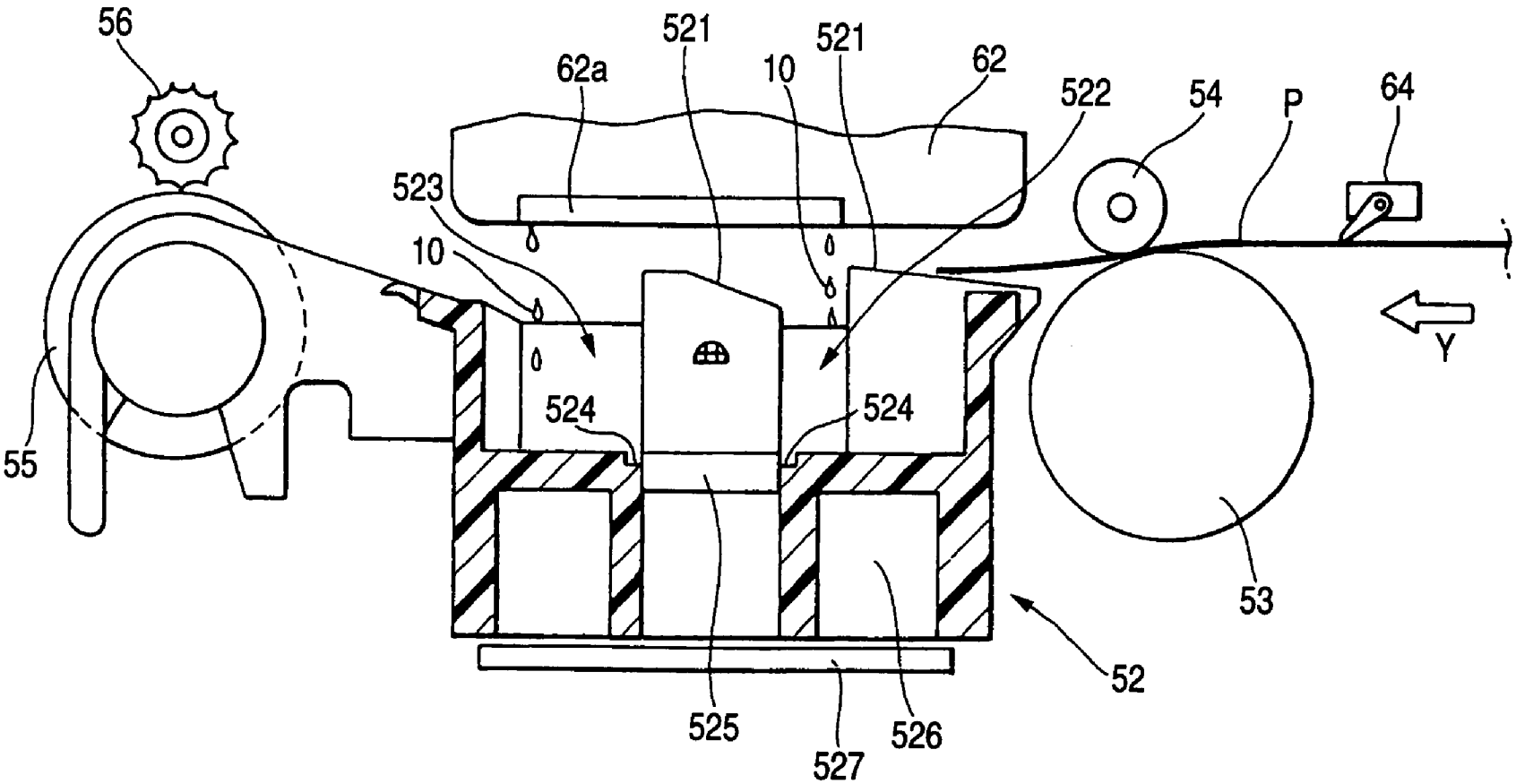
FIG. 2 is a cross-sectional view of the principal section of the ink jet recording apparatus.

There will be described a third embodiment of the invention in which a recording area is rearranged on the basis of the length of recording paper detected by the paper sensor 64 (FIG. 2).

Figure 12:
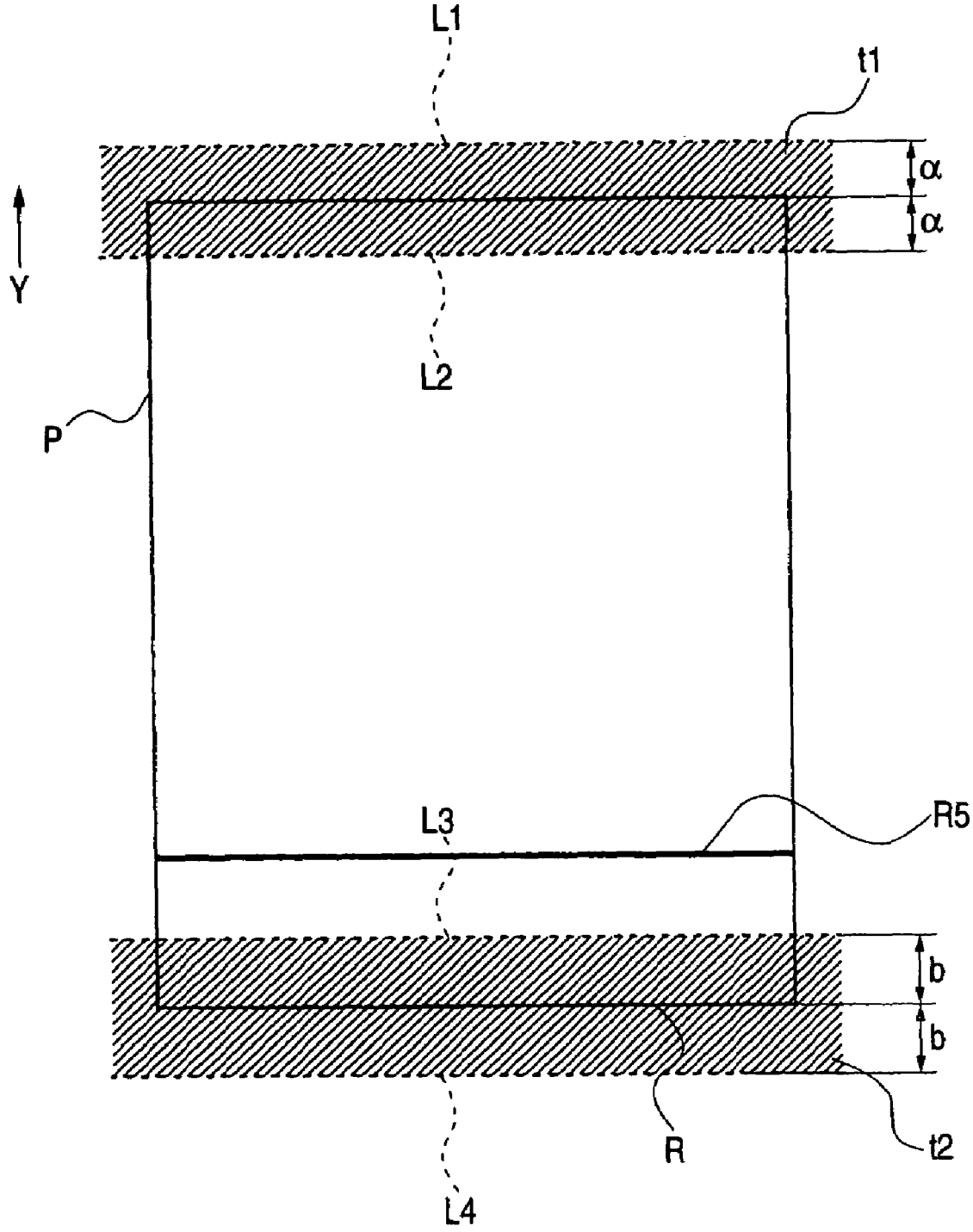
FIG. 12 is a plan view schematically showing a case in which the length of recording paper detected by a paper sensor is shorter than the length of recording paper determined from information about the size of recording paper.

As shown in FIG. 12, when the trailing edge R5 of the recording paper P detected by the paper sensor 64 has reached a position downstream of the trailing edge R determined by the information about the size of recording paper with respect to the subscanning direction Y; that is, when the length of recording paper computed from the trailing edge R5 detected by the paper sensor 64 is shorter than that of recording paper determined from information about the size of recording paper, the ink 10 is ejected from all the nozzles of the nozzle group N to the platen 52 after passage of the trailing edge R5, thereby staining the platen 52 with the ink 10.

Figure 13:
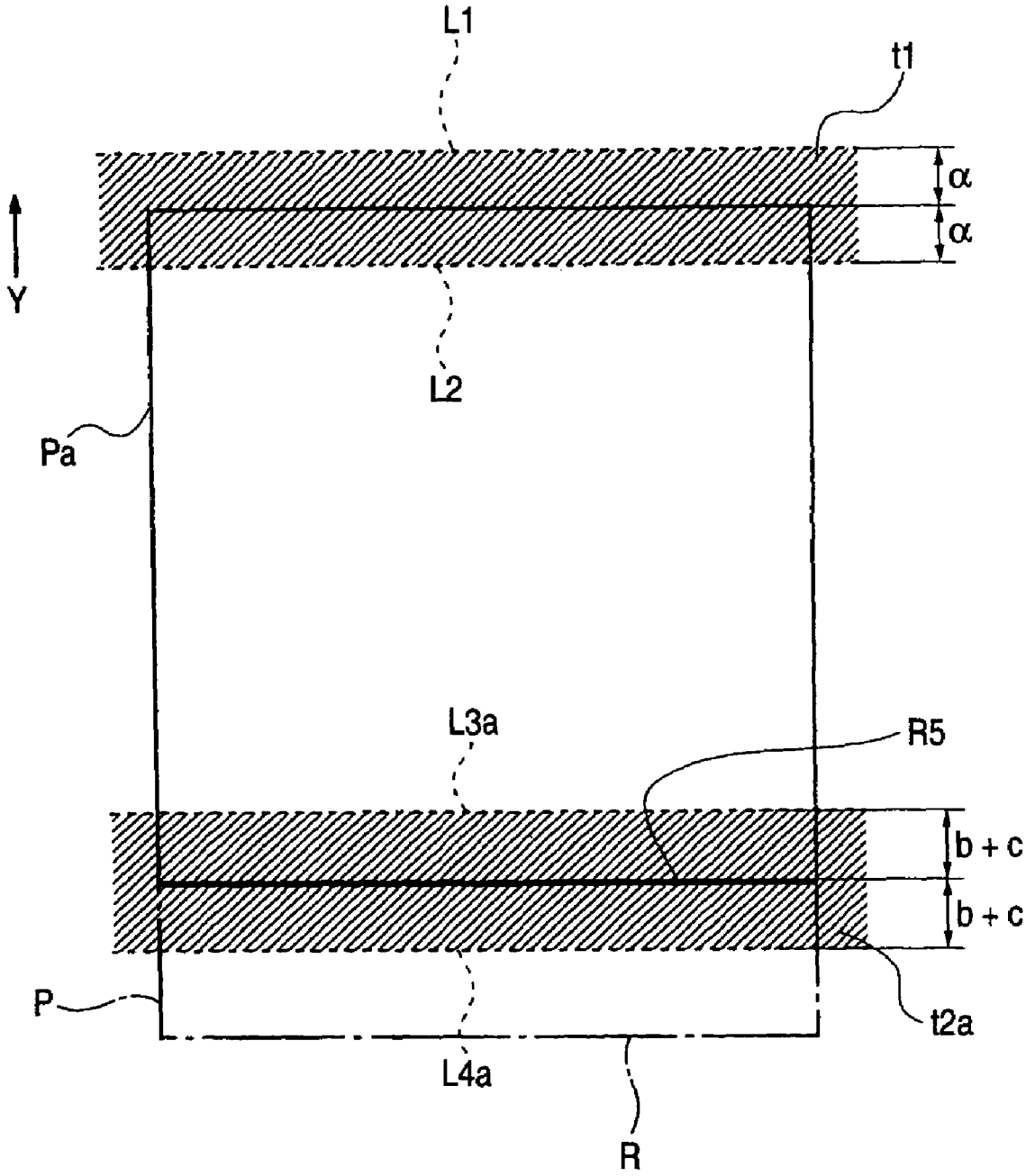
FIG. 13 is a plan view schematically showing a method of performing marginless recording according to a third embodiment of the invention.

FIG. 13 is a plan view schematically showing a state that the first virtual trailing edge L3 and the second virtual trailing edge L4 are rearranged on the basis of the trailing edge R5 of the recording paper P detected by the paper sensor 64 during recording.

First, on the basis of the trailing edge R5 detected by the paper sensor 64, actual recording paper Pa is determined. Next, first and second virtual trailing edges L3*a* and L4*a* of the recording paper Pa are determined. Here, the first virtual trailing edge L3*a* is determined by displacing the trailing edge R5 in a downstream direction with respect to the subscanning direction Y by only an amount yielded by addition of the maximum error "c" detected by the paper sensor 64 to the value (designated by "b") that has been yielded by addition of the transport error level $\beta$ to the paper feed error level $\alpha$. The second virtual trailing edge L4*a* is determined by displacing the trailing edge R5 in an upstream direction with respect to the subscanning direction Y by only an amount yielded by addition of the maximum error "c" detected by the paper sensor 64 to the value (designated by "b") that has been yielded by addition of the transport error level $\beta$ to the paper feed error level $\alpha$. An area which is denoted by t2*a* and is defined between the first virtual trailing edge L3*a* and the second trailing edge L4*a* is reset to an area where recording is performed through use of only a group of nozzles Nr for trailing-marginless recording operation.

Accordingly, even when an actual length of recording paper is shorter than the length of recording paper obtained from information about the size of recording paper, recording can be terminated at the trailing edge R5 of the recording paper P. Hence, there can be prevented staining of the platen 52, which would otherwise be caused when the ink 10 is ejected to the platen 52 after passage of the trailing edge R5 of the recording paper P. Thus, marginless recording of the recording paper P can be performed optimally.

In the embodiment, there may be employed a configuration for resetting a recording area in which a given margin is left at the trailing edge R5 of the recording paper P.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A recording apparatus for recording information on a recording medium without leaving any margins along at least one of four sides thereof, the apparatus comprising:

a transporter, which transports the recording medium in first direction;

a recording head, having a head face formed with nozzles for ejecting ink drops onto the recording medium while being reciprocated in second directions perpendicular to the first direction; and a controller, operable to define:

a first region on the head face so as to include a first group of nozzles among all the nozzles;

a first amount, as a difference between a first reference position at which a leading edge of the recording medium situated at a recording start position is placed and a first shifted position at which the leading edge of the recording medium, which has been most shifted in the first direction and most inclined within a feeding tolerance, is placed;

a first virtual leading edge at a position that is shifted from the first reference position to a downstream side of the first direction by the first amount; and a second virtual leading edge at a position that is shifted from the first reference position to an upstream side of the first direction by the first amount, wherein:

the recording head performs a first type of recording with the first group of nozzles, when an end of the first region in the upstream side of the first direction is situated at the first virtual leading edge; and the recording head performs a second type of recording with all the nozzles, when the end of the first region in the upstream side of the first direction is situated at the second virtual leading edge.

2. The recording apparatus as set forth in claim 1, wherein the controller further defines:

a second region on the head face so as to include a second group of nozzles among all the nozzles;

a second amount, as an amount obtained by adding a maximum tolerance of a dimension of the recording medium in the first direction and a maximum accumulated error within a transporting tolerance of the transporter;

a third amount by adding the first amount and the second amount;

a second reference position at which a trailing edge of the recording medium is placed when the leading edge of the recording medium is placed at the first reference position;

a first virtual trailing edge at a position that is shifted from the second reference position to the downstream side of the first direction by the third amount; and a second virtual trailing edge at a position that is shifted from the second reference position to the upstream side of the first direction by the third amount;

the recording head performs a third type of recording with the second group of nozzles, when an end of the second region in the downstream side of the first direction is situated at the first virtual trailing edge; and the recording head finishes the third type of recording, when an end of the second region in the upstream side of the first direction is situated at the second virtual trailing edge.

3. The recording apparatus as set forth in claim 2, wherein the controller further defines:

first virtual side edges at positions where both ends of the recording medium in the second directions are placed when the trailing edge of the recording medium is placed at the first virtual trailing edge; and second virtual side edges at positions where both ends of the recording medium in the second directions are placed when the trailing edge of the recording medium is placed at the second virtual trailing edge; and the recording head performs the first type, the second type and the third type of recording at regions situated between the first virtual side edges and the second virtual side edges.

4. The recording apparatus as set forth in claim 3, further comprising a data provider, which provides recording data corresponding to a region defined by the first virtual leading edge, the second virtual trailing edge, one of the first virtual side edges and one of the second virtual side edges.

5. The recording apparatus as set forth in claim 2, further comprising:

a detector, which detects the trailing edge of the recording medium to determine an actual dimension of the recording medium in the first direction;

a comparator, which compares the actual dimension with a logical dimension of the recording medium in the first direction which is obtained from inputted medium size information; and an updater, which updates the second reference position based on the actual dimension, when the actual dimension is smaller than the logical dimension.

6. The recording apparatus as set forth in claim 1, further comprising a first ink receiving section, which receives ink drops ejected over the leading edge of the recording medium, wherein a dimension of the first region in the first direction is shorter than a dimension of the first ink receiving section in the first direction by an amount which is twice a positioning tolerance of the first ink receiving section.

7. The recording apparatus as set forth in claim 6, further comprising a second ink receiving section, which receives ink drops ejected over the trailing edge of the recording medium, wherein a dimension of the second region in the first direction is shorter than a dimension of the second ink receiving section in the first direction by an amount which is twice a positioning tolerance of the second ink receiving section.

8. The recording apparatus as set forth in claim 7, further comprising third ink receiving sections, which receive ink drops ejected over the side edges of the recording medium, wherein a dimension of each region between the first virtual side edge and the second virtual side edge in the second directions is shorter than a dimension of each of the third ink receiving sections in the second directions by an amount which is twice a positioning tolerance of the third ink receiving sections.

* * * * *